US005549291A

United States Patent [19]

Devito

[11] Patent Number: 5,549,291

[45] Date of Patent: Aug. 27, 1996

[54] PRINTER WITH MULTIPLE-SIZED SHEETS DUPLEX TRAY ASSEMBLY

[75] Inventor: Gerald M. Devito, Ontario, N.Y.

[73] Assignee: Xerox Corporation, Stamford, Conn.

[21] Appl. No.: 347,666

[22] Filed: Dec. 1, 1994

[51] Int. Cl.[6] ..... B65H 5/06; B65H 29/20; B65H 29/68

[52] U.S. Cl. ..... 271/182; 271/3.03; 271/314; 271/301

[58] Field of Search ..... 271/3.03, 65, 182, 271/186, 223, 301, 314

[56] References Cited

U.S. PATENT DOCUMENTS

| | | | |
|---|---|---|---|
| 4,480,825 | 11/1984 | Landa | 271/182 X |
| 4,632,377 | 12/1986 | Browse | 271/9 |
| 5,165,675 | 11/1992 | Kanaya | 271/3.03 |

FOREIGN PATENT DOCUMENTS

| | | | |
|---|---|---|---|
| 62-16982 | 1/1987 | Japan | 271/314 |

*Primary Examiner*—F. J. Bartuska
*Attorney, Agent, or Firm*—Tallam I. Ngutt

[57] ABSTRACT

A printing machine having a sheet path for moving sheets, a buffer tray assembly for receiving and holding sheets of various sizes and orientation without skewing such sheets. The buffer tray assembly includes a sheet feeding unit, mounted adjacent to and upstream of a sheet holding unit thereof, relative to sheet movement, for feeding, seriatim and without skewing, sheets of various sizes and orientations from the path into the sheet holding unit. The sheet feeding unit includes a sheet driving roller. The sheet driving roller has a plurality of operative positions that are spaced laterally along the sheet cross-path dimension of the sheet path, and that correspond respectively to the midpoints of cross-path dimensions of the various size sheets being fed into the sheet holding unit for feeding and stacking sheets without sheet skew.

13 Claims, 3 Drawing Sheets

PRINTER WITH MULTIPLE-SIZED SHEETS DUPLEX TRAY ASSEMBLY

BACKGROUND OF THE INVENTION

This invention relates to electrostatographic reproduction machines, including printers, and more particularly to such a machine having a duplex tray assembly for handling sheets of various sizes and orientations without a risk of sheet jams due to sheet skew.

In electrostatographic printing, sheet stacking with bottom feeding are known, as is disclosed for example in U.S. Pat. No. 4,632,377 issued Dec. 30, 1986 to Browse. Such stacking is useful, for example, when performing duplex copying in electrostatographic printing machines. Duplex copying, that is, copying image information to both sides of a single sheet of paper, is a well known feature of copying or printing machines. Duplex copying is desirable because it reduces the amount of paper required in a copying job, as compared to simplex (single side) copying. In duplex copying, first side sheet copies are produced and stacked temporarily in a duplex tray. When a set of first side sheet copies is complete, the sheet copies are refed seriatim out of the duplex tray and returned to the imaging loop of the machine, with an odd number of inversions in the sheet path in order to each receive a second side image properly registered on a second side thereof. The resulting duplex sheet copies are subsequently moved to an output tray or finisher.

In printing machines for performing duplex copying as such, it is known to provide a paper or sheet path in addition to imaging means that are each capable of accommodating LEF (long edge first) orientation sheets, or SEF (short edge first) orientation sheets. For example, in very low cost small machines it is desirable to provide only narrow imaging means for accommodating 8½×11 inch sheets that are fed in an SEF (short edge first) orientation along a sheet path. The width or cross-path dimension of the sheet path and of the imaging elements in such a machine are therefore only required to accommodate the 8½ inch dimension of the sheet, not the 11 inch dimension thereof. Similarly, in larger machines, it may be required to provide wider means for accommodating sheets having a cross-path edge dimension of at least 11 inches. Ordinarily, this is the long edge of an 8½×11 inch sheet, fed LEF (long edge first). One current trend in the design of such machines is towards increasing the speed or number of sheet copies each machine can produce per unit time. Higher speeds as such therefore are ordinarily likely to create special sheet handling problems, such as skewing of sheets received and stacked in the duplex tray.

Skewed sheets in the duplex tray are particularly undesirable because such sheets already have a registered image on a first side thereof, and must be refed to receive a second image on its second side such that the second image is registered both to the second side and to the image on the first side. A skewed sheet in the duplex tray is likely to be refed misregistered, as well as likely to cause a jam along the sheet path.

SUMMARY OF THE INVENTION

In accordance with one aspect of the present invention, there is provided in a printing machine having a sheet path for moving sheets, a buffer tray assembly for receiving and holding sheets of various sizes and orientation without skewing such sheets. The buffer tray assembly includes a sheet holding unit mounted along the sheet path and having a cross-path dimension greater than a maximum cross-path dimension of sheets to be moved along the path. The buffer tray assembly also includes a sheet feeding unit, mounted adjacent to and upstream of the sheet holding unit, relative to sheet movement, for feeding, seriatim and without skewing, sheets of various sizes and orientations from the path into the sheet holding unit. The sheet feeding unit includes sheet driving means, that has a plurality of operative positions which are spaced laterally along the sheet cross-path dimension of the sheet path, and which correspond respectively to the midpoints of cross-path dimensions of the various size sheets so as to feed sheets without sheet skew.

In accordance with another aspect of the present invention, there is provided a printing machine comprising imaging means for forming toner images, including a first toner image and a second toner image, on a surface. The sheet moving means includes a sheet path for moving a sheet in a sheet direction to receive and carry the first toner image on a first side thereof. A duplex tray is mounted along the sheet path for temporarily holding the first toner image carrying sheet for subsequent movement to receive the second toner image on a second side thereof. A sheet stacking assembly mounted along the sheet path and upstream of the duplex tray for stacking first toner image carrying sheets in the duplex tray. The sheet stacking assembly includes a movable sheet feeding roller having a plurality of operative positions including first and second operative positions each corresponding to a midpoint of a cross-path dimension of a sheet to be stacked.

The sheet stacking assembly also includes a plurality of retard pads, including at least first and second retard pads mounted spaced laterally from each other along a cross-path dimension of the sheet path for controllably and frictionally feeding sheets one at a time into the duplex tray. The first and second retard pads are also mounted each at a position corresponding to a midpoint of a cross-path dimension of a sheet to be stacked in the duplex tray. As such, the plurality of operative positions of the movable sheet feeding roller are aligned individually in the in-path direction with individual retard pads of the plurality of retard pads for feeding sheets without sheet skew.

Other features of the present invention will become apparent from the following drawings and description.

BRIEF DESCRIPTION OF THE DRAWINGS

In the detailed description of the invention presented below, reference is made to the drawings, in which.

DETAILED DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 2A:
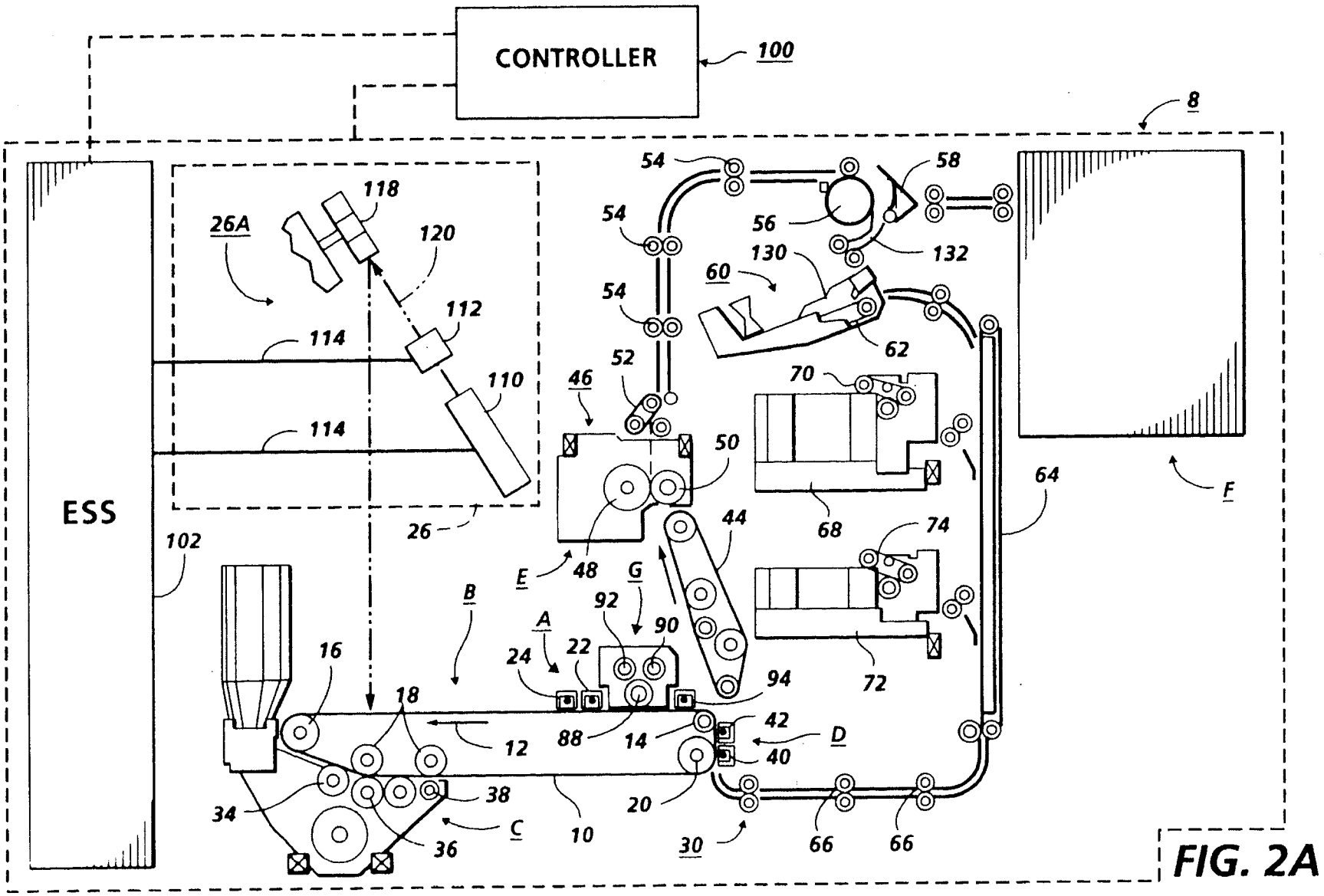
FIGS. 2A and 2B are a schematic representation in cross section of an electrostatographic printing machine including the duplex tray assembly according to the present invention.

Referring to FIG. 2A of the drawings, one embodiment of an exemplary electrostatographic printing machine 8 is illustrated incorporating the features of the present invention. As shown, the machine 8 employs a photoconductive belt 10. Preferably, the photoconductive belt 10 is made from a photoconductive material. Belt 10 moves in the direction of arrow 12 to advance successive portions thereof sequentially through the various processing stations disposed about a path of movement of the belt. Belt 10 is entrained about stripping roller 14, tensioning roller 16, idler roll 18 and drive roller 20. Stripping roller 14 and idler roller 18 are mounted rotatably so as to rotate with belt 10. Tensioning roller 16 is resiliently urged against belt 10 to maintain belt 10 under the desired tension. Drive roller 20 is rotated by a motor coupled thereto by suitable means such as a belt drive. As roller 20 rotates, it advances belt 10 in the direction of arrow 12.

Initially, a portion of the photoconductive surface passes through charging station A. At charging station A, two corona generating devices indicated generally by the reference numerals 22 and 24 charge the photoconductive belt 10 to a relatively high, substantially uniform potential. Corona generating device 22 places all of the required charge on photoconductive belt 10. Corona generating device 24 acts as a leveling device, and fills in any areas missed by corona generating device 22.

Next, the charged portion of the photoconductive surface is advanced through imaging station B. At the imaging station B, an imaging module indicated generally by the reference numeral 26, records an electrostatic latent image on the photoconductive surface of the belt 10. Imaging module 26, for example, includes a raster output scanner (ROS) 26A. The ROS 26A lays out the electrostatic latent image in a series of horizontal scan lines with each line having a specified number of pixels per inch. Other types of imaging systems may also be used employing, for example, a pivoting or shiftable LED write bar or projection LCD (liquid crystal display) or other electro-optic display as the "write" source.

The (ROS) 26A, for example, includes a laser 110 for generating a collimated beam of monochromatic radiation 120, and an electronic control subsystem (ESS) 102, that is located in the machine electronic printing controller 100. The ESS as shown transmits to the laser 110 a set of electrical signals, via a bus 114, which correspond to a series of pixels or picture elements. The ROS 26A also includes a modulator and beam shaping optics unit 112 which modulates the beam 120 in accordance with the image information received from the ESS. As shown, a rotatable polygon 118 having mirror facets for sweep-deflecting the beam 120 into a beam 122 for forming raster scan lines which sequentially expose the surface of the belt 10 at imaging station B.

Thereafter, belt 10 advances the electrostatic latent image recorded thereon to development station C. Development station C has three magnetic brush developer rolls indicated generally by the reference numerals 34, 36 and 38. A paddle wheel picks up developer material and delivers it to the developer rolls. When the developer material reaches rolls 34 and 36, it is magnetically split between the rolls with half of the developer material being delivered to each roll. Photoconductive belt 10 is partially wrapped about rolls 34 and 36 to form extended development zones. Developer roll 38 is a clean-up roll. A magnetic roll, positioned after developer roll 38, in the direction of arrow 12 is a carrier granule removal device adapted to remove any carrier granules adhering to belt 10. Thus, rolls 34 and 36 advance developer material into contact with the electrostatic latent image. The latent image attracts toner particles from the carrier granules of the developer material to form a toner powder image on the photoconductive surface of belt 10.

Belt 10 then advances the toner powder image to transfer station D. At transfer station D, a copy sheet is moved into contact with the toner powder image. First, photoconductive belt 10 is exposed to a pre-transfer light from a lamp (not shown) to reduce the attraction between photoconductive belt 10 and the toner powder image. Next, a corona generating device 40 charges the copy sheet to the proper magnitude and polarity so that the copy sheet is tacked to photoconductive belt 10 and the toner powder image attracted from the photoconductive belt to the copy sheet. After transfer, corona generator 42 charges the copy sheet to the opposite polarity to detack the copy sheet from belt 10. Conveyor 44 advances the copy sheet to a fusing station E.

Fusing station E includes a fuser assembly indicated generally by the reference numeral 46 which heats and permanently affixes the transferred toner powder image to the copy sheet. Preferably, fuser assembly 46 includes a heated fuser roller 48 and a pressure roller 50 with the powder image on the copy sheet contacting fuser roller 48. The pressure roller is cammed against the fuser roller to provide the necessary pressure to fix the toner powder image to the copy sheet. The fuser roll is internally heated by a quartz lamp. Release agent, stored in a reservoir, is pumped to a metering roll. A trim blade trims off the excess release agent. The release agent transfers to a donor roll and then to the fuser roll.

After fusing, the copy sheets may be fed through a decurler 52. Decurler 52 bends the copy sheet in one direction to put a known curl in the copy sheet and then bends it in the opposite direction to remove that curl. After that, forwarding rollers 54 then advance the sheet to a duplex turn roll 56, and to Duplex solenoid gate 58 which then guides the sheet on a first pass either to the finishing station F if doing simplex only, or to the duplex tray assembly 60 of the present invention (to be described below), if doing duplex. When doing duplex, duplex solenoid gate 58 diverts the sheet into duplex tray 60 in a manner according to the present invention. Duplex tray 60 provides intermediate or buffer storage for simplex sheets, that is, those sheets that have been printed on one side only, and on which an image will be subsequently printed on the second, and opposite side thereof. The simplex sheets are stacked in duplex tray 60 facedown on top of one another and in the order in which they are copied.

In order to complete duplex copying, the simplex sheets in tray 60 are fed seriatim, by bottom feeder 62 from tray 60 back to transfer station D via conveyor 64 and rollers 66 to each transfer-receive a second toner powder image on a second and opposite side thereof. Inasmuch as successive bottom sheets are fed from duplex tray 60, the proper or clean side of the copy sheet is positioned in contact with belt 10 at transfer station D so that the toner powder image is transferred thereto. After such second image transfer thereonto, the duplex sheet is then fed in a second pass through the same path as the simplex sheet, that is, passed duplex roll 56 and duplex gate 58, to be advanced to finishing station F. At finishing station F, copy sheets are stacked in a compiler tray and attached by either a binder or a stapler to one another to form sets. In either case, a plurality of sets of documents are formed in finishing station F.

The copy sheets fed to transfer station D are fed from sheet supplies 68, 72. The sheet supplies 68, 72, for example, each include an elevator driven by a bidirectional AC motor, with the ability to drive the tray up or down. When the tray is in the down position, stacks of copy sheets are loaded thereon or unloaded therefrom. In the up position, successive copy sheets may be fed therefrom by sheet feeder 70.

Sheet feeder 70 is a friction retard feeder utilizing a feed belt and take-away rolls to advance successive copy sheets to transport 64 which advances the sheets to rolls 66 and then to transfer station D.

Still referring to FIG. 2A, after the copy sheet is separated from the photoconductive belt 10, some residual particles invariably remain adhering thereto. After transfer, photoconductive belt 10 passes beneath corona generating device 94 which charges the residual toner particles to the proper polarity. Thereafter, the pre-charge erase lamp (not shown), located inside photoconductive belt 10, discharges the photoconductive belt in preparation for the next charging cycle. Residual particles are removed from the photoconductive surface at cleaning station G. Cleaning station G includes an electrically biased cleaner brush 88 and two de-toning rolls 90, 92. The reclaim roll is electrically biased negatively relative to the cleaner roll so as to remove toner particles therefrom. The waste roll is electrically biased positively relative to the reclaim roll so as to remove paper debris and wrong sign toner particles. The toner particles on the reclaim roll are scraped off and deposited in a reclaim auger (not shown), where it is transported out of the rear of cleaning station G.

Various machine functions are regulated by a controller 100. The controller 100 is preferably a programmable microprocessor which controls all of the machine functions hereinbefore described. Control of all of the functions heretofore described may be accomplished by controller 100 through use of conventional control switch and sensor inputs from the various components of the printing machine, including inputs from an operator console. For example, conventional sheet path sensors or switches may be utilized to keep track of the position of document sheets, and of copy sheets.

Figure 2B:
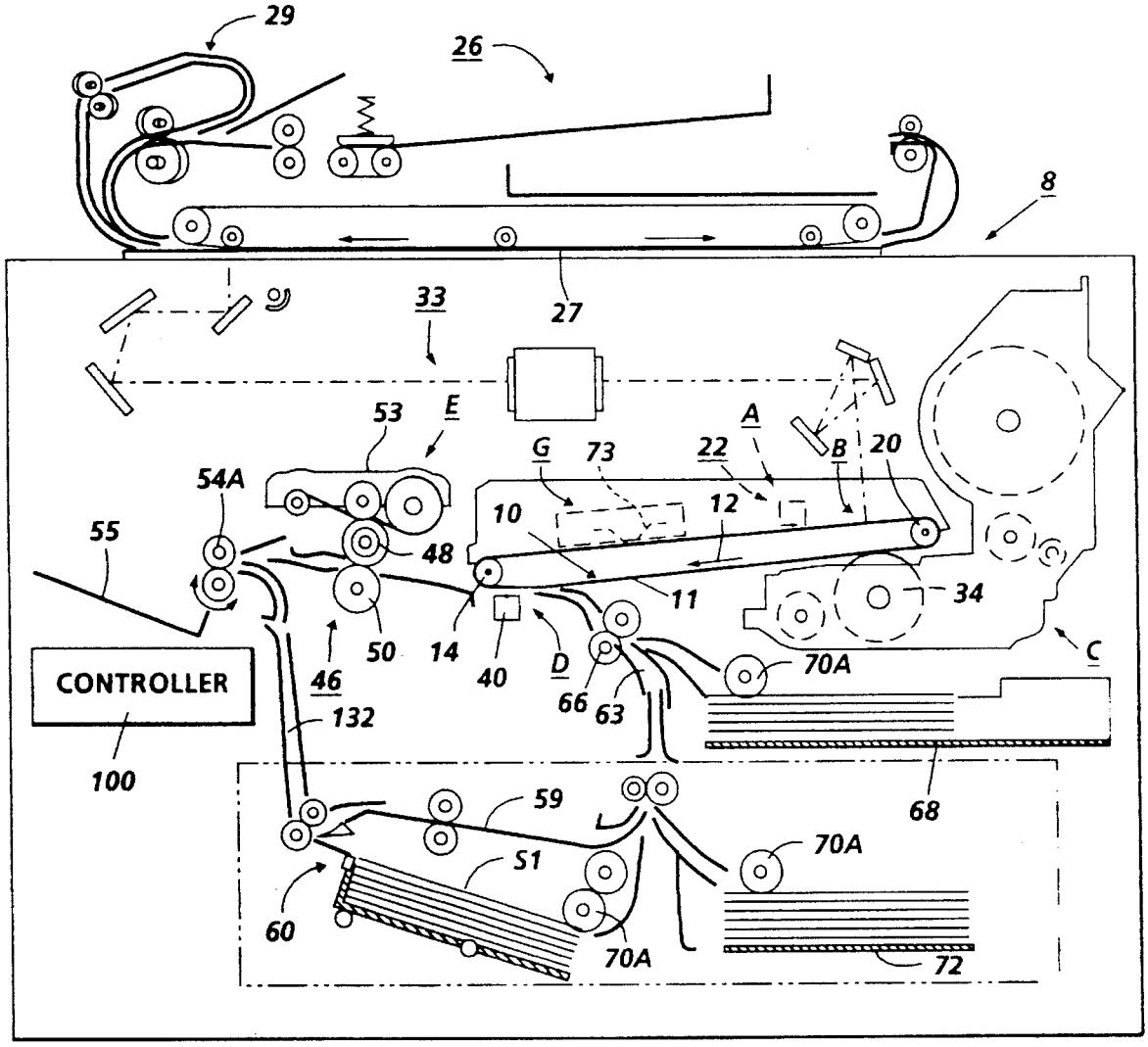

Referring now to FIG. 2B of the drawings, another embodiment of an exemplary electrostatographic printing machine 9 is illustrated incorporating the features of the present invention. As shown, machine 9 employs a belt 10 having a photoconductive surface 11. Preferably, the photoconductive belt 10 is made from a photoconductive material. Belt 10 moves in the direction of arrow 12 to advance successive portions thereof sequentially through the various processing stations disposed about a path of movement of the belt. Belt 10 is entrained for example about a first roller 14, and drive roller 20. The rollers 14 and 20 are mounted rotatably so as to rotate with belt 10. Drive roller 20 is rotated by a motor (not shown) coupled thereto by suitable means such as a belt drive. As roller 20 rotates, it advances belt 10 in the direction of arrow 12.

Initially, a portion of the photoconductive surface 11 passes through charging station A. At charging station A, a corona generating device 22 charges the photoconductive surface 11 of belt 10 to a relatively high, and substantially uniform potential. Next, the charged portion of the photoconductive surface is advanced through imaging station B. At the imaging station B, an imaging module indicated generally by the reference numeral 26, records an electrostatic latent image on the photoconductive surface 11 of the belt 10. Imaging module 26, for example, includes a platen 27, a document handler 29, and optical exposure means shown generally as 31. Such optical exposure means can be a light lens system as shown, or a raster output scanner (ROS) system as are well known. A ROS system lays out the electrostatic latent image in a series of horizontal scan lines with each line having a specified number of pixels per inch. The light lens exposure system as shown reflects light rays imagewise off of a document positioned on the platen 27, and onto the charged portion of surface 11 to form a latent image.

Thereafter, belt 10 advances the electrostatic latent image recorded thereon to development station C. Development station C for example has a magnetic brush developer roll 34 that advances developer material containing carrier granules and charged toner particles into contact with the electrostatic latent image on surface 11. The latent image attracts charged toner particles from the carrier granules of the developer material so as to form a toner powder image on the photoconductive surface 11.

Belt 10 then advances the toner powder image on surface 11 to a transfer station D. At transfer station D, a copy sheet is fed into contact with the toner powder image. First, photoconductive belt 10 may be exposed to a pre-transfer light from a lamp (not shown) to reduce the attraction between photoconductive belt 10 and the toner powder image. Next, a corona generating device 40 charges the copy sheet to the proper magnitude and polarity so that the copy sheet is tacked to photoconductive surface 11 and the toner powder image is attracted from the surface 11 to the copy sheet. After transfer, another corona generating device (not shown) may charge the copy sheet to the opposite polarity to detack the copy sheet from surface 11. The copy sheet is then advanced to a fusing station E.

Fusing station E includes a fuser assembly indicated generally by the reference numeral 46 which heats and permanently affixes the transferred toner powder image to the copy sheet. Preferably, fuser assembly 46 includes a heated fuser roller 48 and a pressure roller 50 with the powder image on the copy sheet contacting fuser roller 48. The pressure roller is cammed against the fuser roller to provide the necessary pressure to fix the toner powder image to the copy sheet. The fuser roll may be internally heated by a quartz lamp. Release agent may be applied by a device 51 to the fuser roll 48.

After fusing, the copy sheets is fed to, and or through, reversible rollers 54A which then either advance the sheet if finished (in simplex or duplex), to an output tray 55, or reverses the sheet into a duplex path 132. Duplex path 132 then guides the sheet either to an on-the-fly duplex sheet path 59, or into the duplex tray assembly 60 of the present invention (to be described below). When doing duplex on-the-fly (i.e. with no buffer), sheets reversed by the rollers 54A into the path 132 are directed into the fly path 59, and are then directly advanced back to the transfer station D. When doing duplex copying with a buffer according to the present invention, the sheets reversed by the rollers 54A into the path 132 are directed instead into the duplex tray assembly 60 in a manner according to the present invention. Duplex tray assembly 60 provides intermediate or buffer storage for simplex sheets, that is, those sheets that already have been printed on one side only, and on which an image will be subsequently printed on the second, and opposite side thereof. The simplex sheets are stacked without skew according to the present invention, in duplex tray assembly 60 facedown on top of one another and in the order in which they are copied.

In order to complete duplex copying, the simplex sheets in duplex tray assembly 60 are fed seriatim back to transfer station D via sheet path 61 and rollers 66 in order to each transfer-receive a second toner powder image on a second and opposite side thereof. Inasmuch as successive sheets are fed from duplex tray assembly 60, the proper or clean side of the copy sheet is positioned in contact with belt 10 at transfer station D so that the toner powder image is transferred thereto. After such second image transfer thereonto, the duplex sheet is then fed in a second pass through the same path as the simplex sheet, that is, through fusing assembly 46 and feed rollers 54A, as finished sheets for output to tray 55.

The copy sheets fed to transfer station D are fed from sheet supplies 68, 72. The sheet supplies 68, 72, for example, each include an elevator driven by a bidirectional AC motor, with the ability to drive the tray up or down. When the tray is in the down position, stacks of copy sheets are loaded thereon or unloaded therefrom. In the up position, successive copy sheets may be fed therefrom by sheet feeder 70A which advances the sheets to the rolls 66 and then to transfer station D.

Invariably, after the copy sheet is separated from the photoconductive surface 11 of belt 10, some residual particles remain adhering thereto. After transfer, photoconductive surface 11 may be passed beneath a corona generating device (not shown) which charges the residual toner particles to the proper polarity. Thereafter, cleaning elements such as blades 73 remove the residual toner particles as waste toner from surface 11. The waste toner may be deposited into a reclaim auger (not shown), where it is transported out of the rear of cleaning station G.

Still referring to FIG. 2B, as was the case in FIG. 2A, the various machine functions are regulated by a controller 100. The controller 100 is preferably a programmable microprocessor which controls all of the machine functions hereinbefore described. Control of all of the functions heretofore described may be accomplished by controller 100 through use of conventional control switch and sensor inputs from the various components of the printing machine, including inputs from an operator console. For example, conventional sheet path sensors or switches may be utilized to keep track of the position of document sheets, and of copy sheets.

It is believed that the foregoing descriptions of exemplary machines 8 and 9 are sufficient for purposes of the present application to illustrate the general operation of an electrostatographic printing machine incorporating the duplex tray assembly 60 of the present invention.

Figure 1:
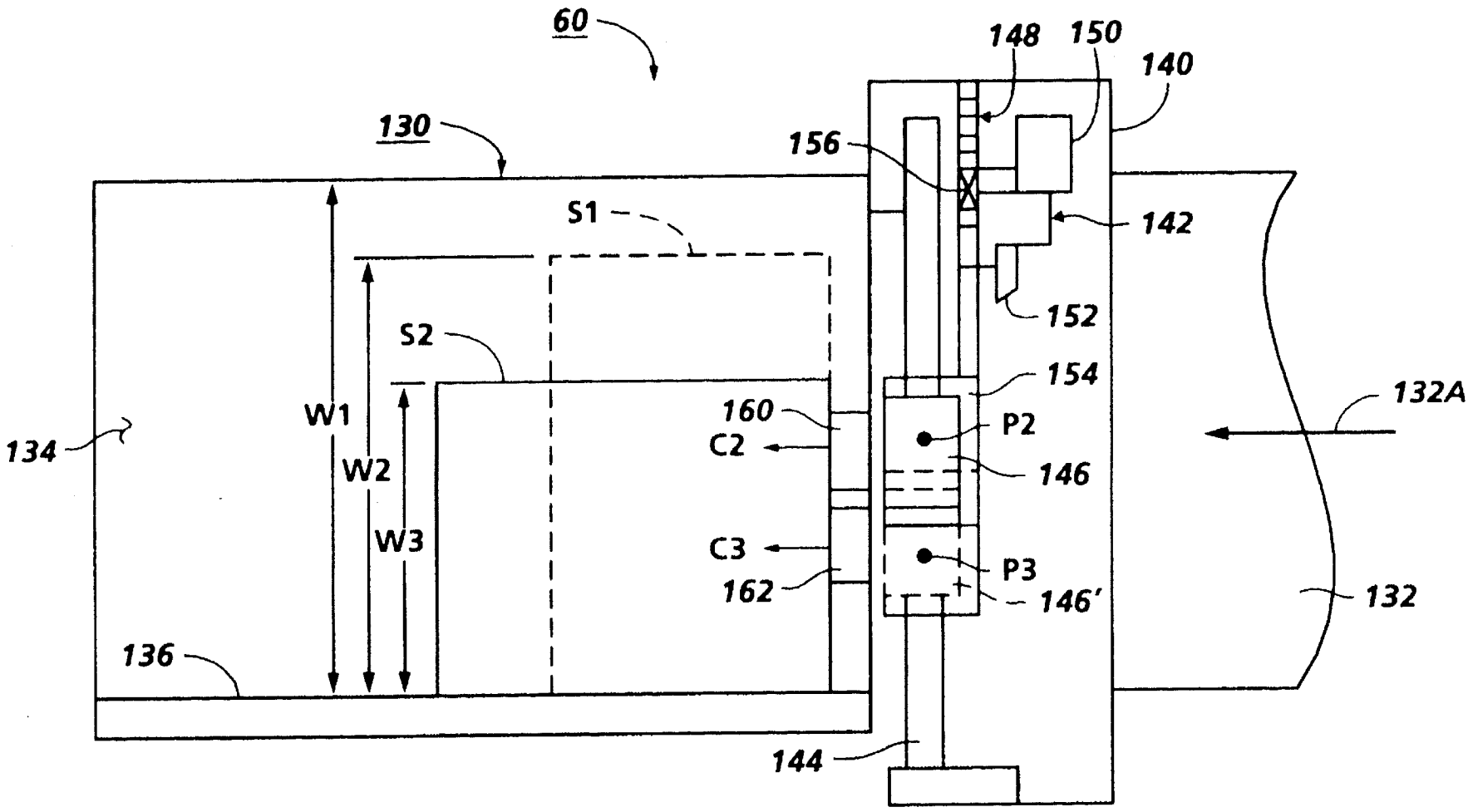
FIG. 1 is a schematic top view of the duplex tray assembly of the present invention.

Referring now to FIG. 1, the buffer tray assembly 60 of the present invention is illustrated, and is suitable for receiving and holding simplex sheets of various sizes and orientation without skewing, such sheets. As shown, the buffer tray assembly 60 includes a sheet holding unit or tray 130 that is mounted along the path 132 of simplex sheets moving in the direction of arrow 132A from the reversible rollers 54A into the duplex tray assembly 60. The sheet holding unit 130 includes a base 134 for supporting sheets such as S1, S2 of various sizes and orientations, and a registration edge 136 for aligning such sheets being held therein along an edge thereof. As illustrated, the sheet holding unit 130 has an overall cross-path dimension W1 that is preferably sized to contain a maximum cross-path dimension, e.g. W2, W3 of sheets to be moved along the path and into duplex tray assembly 60. The duplex tray assembly 60 also includes a sheet feeding unit shown generally as 140. Sheet feeding unit 140 as shown is mounted adjacent to, and upstream of the sheet holding unit 130 when considered relative to sheet movement (arrow 132A) into the sheet holding unit. Operatively, sheet feeding unit 140 functions to feed the sheets S1, S2 of various sizes and orientations seriatim, from the sheet path 132, and without skew, into the sheet holding unit 130.

As further shown, the sheet feeding unit 140 includes sheet driving means 142 which is comprised of a cross-path shaft 144, and a feed roller shown as 146, 146' (as seen moved into a second position). Alternatively too, two separately drivable rollers could be used in place of the single axially movable roller 146. The feed roller 146 is mounted rotatably on the shaft 144 for contacting and moving each sheet being driven thereby into the sheet holding unit 130. Power means shown as a gear assembly 148 are provided and are coupled to the feed roller 146. A motor 150 drives the gear assembly 148 to rotate the feed roller 146. The feed roller 146 is also movable axially along the shaft 144 for positioning operatively into each of a plurality of operative positions including, for example, a first position P2, and a second position P3 that are spaced laterally along the sheet cross-path direction. Each of the plurality of operative positions such as P2, P3 importantly corresponds to a center-point C2, C3 respectively of a cross-path dimension W2, W3, respectively, of a sheet being fed into the sheet holding unit 130. The feed roller 146, 146' is positioned into each of the plurality of operative positions P2, P3 such that the longitudinal midpoint of the feed roller is coincident with such position and with the center point C2, C3 of each sheet cross-path dimension W2, W3. A sensor 152 connected to the motor 150 is used for sensing the cross-path positions of the feed roller 146 along the shaft 144. The gear assembly 148, for example, also includes a movable rack 154 that is connected to the feed roller 146 for movement therewith, and a gear 156 coupled to the motor 150 for moving the rack 154.

The buffer tray assembly 60 of the present invention further includes a plurality of retard pads, including at least first retard pad 160 and a second retard pad 162, that are mounted spaced laterally from each other along a cross-path direction, for effectively controlling the frictional feeding of sheets seriatim into the sheet holding unit 130. Each of the retard pads 160, 162 is mounted downstream of the sheet driving means 142 relative to sheet movement, and, as shown, is aligned in an in-path direction with the operative position P2, P3, respectively of the plurality of operative positions of the sheet driving means. As such, the first 160 and second 162 retard pads are thus mounted each at a position corresponding to the midpoints C2, C3 of the cross-path dimensions W2, W3 of various sizes and orientations of sheets to be stacked in the duplex tray without sheet skew.

Further, in accordance with the present invention, the programmable controller 100 is connected to sheet feeding and holding or stacking units 130, 140 respectively for controlling movement of the sheet feeding roller 146 responsively to a sensed or programmed cross-path dimension W2, W3 of a sheet being moved along the sheet path 132. As such, various sizes and orientations of sheets having cross-path dimensions such as W2, W3 can be effectively fed and stacked in the sheet holding unit 130 for refeeding without sheet skew.

The features of the present invention are equally suitable for use in a sheet stacking assembly including a sheet holding unit for holding different stacks of sheets, wherein each stack has a different width located crosswise to a sheet path, and each of the stack contains sheets having a common width. A a cross-path movable sheet feeder unit feeds sheets having different widths into the sheet holding unit. Means are provided for sensing a common width of sheets to be fed by the sheet feeding unit, and means responsive to the sensing means are provided for moving the sheet feeder to one of a number of cross-path feeding positions each being located at a point coincident with a midpoint of a sensed common width of sheets to be fed by the sheet feeder.

It is, therefore, apparent that there has been provided in accordance with the present invention, a buffer tray assembly including a sheet holding unit, and a sheet feeding unit for feeding sheets of various sizes and orientations, seriatim and without skewing, from a sheet path into the sheet holding unit. The sheet feeding unit includes sheet driving means having a plurality of operative positions that are spaced laterally along the sheet cross-path dimension of the sheet path, and that correspond respectively to the midpoints of cross-path dimensions of the various size sheets being fed into the sheet holding unit.

While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. In a printing machine having a sheet path for moving sheets, a buffer tray assembly for receiving and holding sheets of various sizes and orientation without skewing such sheets, the buffer tray assembly comprising:

(a) a sheet holding unit mounted along the sheet path and having a cross-path dimension sized to contain a maximum cross-path dimension of sheets to be moved along the path;

(b) a sheet feeding unit, mounted adjacent to and upstream of said sheet holding unit relative to sheet movement, for feeding seriatim sheets of various sizes and orientations from the path without skew into said sheet holding unit, said sheet feeding unit including driving means, said sheet driving means having a plurality of operative positions spaced laterally along said sheet cross-path direction and corresponding to a center-point of a cross-path dimension of a sheet being fed into said sheet holding unit; and a plurality of retard pads each being aligned in an in-path direction with an operative position of said plurality of operative positions of said sheet driving means, for controllably and frictionally feeding sheets into said sheet holding unit.

2. The buffer tray assembly of claim 1, wherein said sheet holding unit includes a base for supporting sheets and a registration edge for aligning sheets being held therein.

3. The buffer tray assembly of claim 1, wherein said sheet driving means comprises:

(a) a cross-path shaft;

(b) a feed roller mounted rotatably on said shaft for contacting and moving a sheet being driven thereby; and (c) power means connected to said shaft for rotating said feed roller.

4. The buffer tray assembly of claim 3, wherein said feed roller is movable along said shaft for positioning operatively into each of said plurality of operative positions.

5. The buffer tray assembly of claim 3, wherein said power means comprises a gear assembly coupled to said feed roller, and a motor for driving said gear assembly.

6. The buffer tray assembly of claim 1, wherein each said plurality of retard pads is mounted downstream of said sheet driving means relative to sheet movement.

7. The buffer tray assembly of claim 5 wherein said feed roller is positioned into each of said plurality of operative positions such that the longitudinal midpoint of said feed roller is coincident with each said operative position.

8. The buffer tray assembly of claim 5 including sensors connected to said motor for sensing positions of said feed roller.

9. The buffer tray assembly of claim 5 wherein said gear assembly includes a movable rack connected to said feed roller for movement therewith, and a gear coupled to said motor for moving said rack.

10. A printing machine comprising:

(a) imaging means for forming toner images, including a first toner image and a second toner image, on a surface;

(b) sheet moving means including a sheet path for moving a sheet in a sheet direction to receive and carry said first toner image on a first side thereof;

(c) a duplex tray mounted along said sheet path for temporarily holding said first toner image carrying sheet for subsequent movement to receive said second toner image on a second side thereof; and (d) a sheet stacking assembly mounted along said sheet path and upstream of said duplex tray for stacking first toner image carrying sheets in said duplex tray, said sheet stacking assembly including:

(i) a plurality of retard pads for controllably and frictionally feeding sheets seriatim into said duplex tray, said plurality of retard pads, including at least first and second retard pads mounted spaced laterally from each other along a cross-path direction, said first and second retard pads being mounted each at a position corresponding to a midpoint of a cross-path dimension of a sheet to be stacked in said duplex tray; and (ii) a movable sheet feeding roller having a plurality of operative positions aligned individually in an in-path direction with individual retard pads of said plurality of retard pads, said plurality of operative positions of said movable sheet feeding roller including first and second operative positions each corresponding to a midpoint of a cross-path dimension of a sheet to be stacked.

11. The printing machine of claim 10 including a programmable controller connected to said sheet stacking means for controlling movement of said sheet feeding roller responsively to a cross-path dimension of a sheet being moved along said sheet path.

12. A sheet stacking assembly for stacking sheets without skew, the sheets being moved along a sheet path, the stacking assembly comprising:

(a) a sheet holding unit for holding different stacks of sheets, each stack having a different width located crosswise to said sheet path, and each said stack containing sheets having a common width;

(b) a cross-path movable sheet feeder unit for feeding sheets having different widths into said sheet holding unit;

(c) means for sensing a common width of sheets to be fed by said sheet feeding unit; and (d) means responsive to said sensing means for moving said sheet feeder to a cross-path feeding position located at a point coincident with a midpoint of said sensed common width of said sheets to be fed by said sheet feeder.

13. The sheet stacking assembly of claim 12 including a plurality of retard pads, each retard pad of said plurality of retard pads being aligned in an in-path direction with a midpoint of a sensed common width of sheets to be fed by said sheet feeder, for controllably and frictionally feeding sheets without skew into said sheet holding unit.

* * * * *